United States Patent [19]

Bschorr

[11] 4,417,427

[45] Nov. 29, 1983

[54] METHOD AND APPARATUS FOR DAMPING VIBRATIONS IN LARGE STRUCTURES, SUCH AS BUILDINGS

[76] Inventor: Oskar Bschorr, Kepplerstr. 11, 8000) Muenchen 80, Fed. Rep. of Germany

[21] Appl. No.: 251,475

[22] Filed: Apr. 6, 1981

[51] Int. Cl.[3] ..... E02D 27/34

[52] U.S. Cl. ..... 52/167; 52/309.17; 52/727

[58] Field of Search ..... 52/167, 727, 725, 724, 52/393, 309.17, 309.16

[56] References Cited

U.S. PATENT DOCUMENTS

| | | | |
|---|---|---|---|
| 3,078,971 | 2/1963 | Wallerstein, Jr. | 52/727 X |
| 3,513,609 | 5/1970 | Lang | 52/309.17 X |

FOREIGN PATENT DOCUMENTS

| | | | |
|---|---|---|---|
| 2628398 | 12/1977 | Fed. Rep. of Germany | 52/167 |
| 479854 | 11/1975 | U.S.S.R. | 52/167 |
| 727763 | 4/1980 | U.S.S.R. | 52/167 |

*Primary Examiner*—Kenneth Downey
*Attorney, Agent, or Firm*—W. G. Fasse; D. H. Kane, Jr.

[57] ABSTRACT

A large structure such as a building is damped by reinforcing steel rods or bars which are divided into segments which are, at least partially, decoupled from one another in their force or load transmitting capacity. Additionally, the steel segments are enclosed by a damping material layer or film which in turn is encased by a sheet metal jacket. The so prepared reinforcing rods are embedded in the poured concrete of the structure or otherwise secured to the structure in a force transmitting manner. In further embodiment a sheet metal member with checkerboard forming grooves and/or ridges is coated with the damping material at least on one side thereof, preferably the side facing the concrete structure. The sheet metal member is anchored to the concrete structure. In both embodiments vibration causing force components are caused to travel at least partially through the vibration damping material.

20 Claims, 11 Drawing Figures

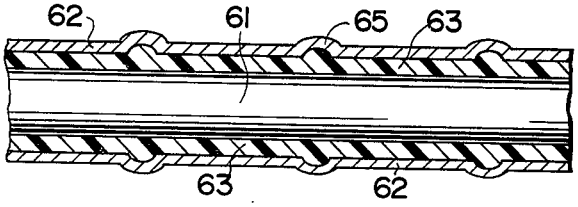
FIG. 7
FIG. 8
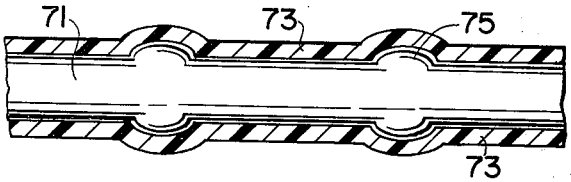
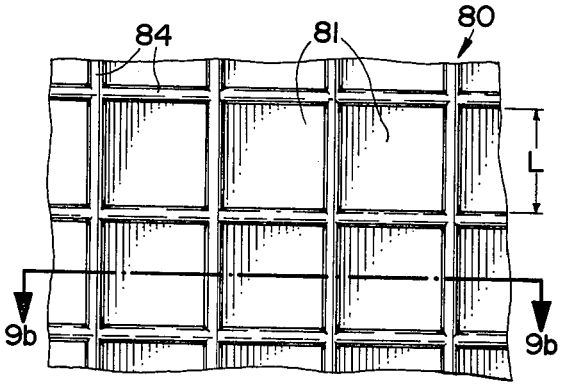
FIG. 9a
FIG. 9b
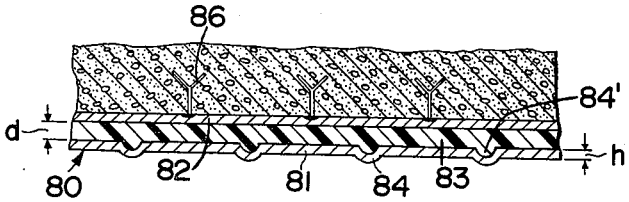
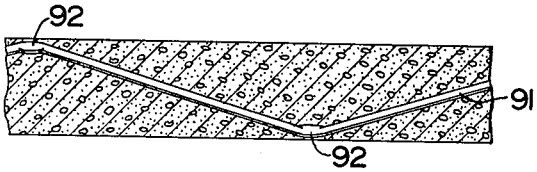
FIG. 10

METHOD AND APPARATUS FOR DAMPING VIBRATIONS IN LARGE STRUCTURES, SUCH AS BUILDINGS

CROSS-REFERENCE TO RELATED APPLICATION

The present application is based on German Ser. No. P 30 06 010.7 filed in the Federal Republic of Germany on Feb. 18, 1980.

BACKGROUND OF THE INVENTION

The invention relates to a method and apparatus for damping vibrations in large structures, such as buildings, bridges, and the like. The damping shall be effective throughout a wide range of vibration-causing frequencies beginning with the noise caused by people walking on concrete floors and reaching all the way to vibrations that may be caused by earthquakes. Vibrations caused by traffic adjacent a building or by overhead aircraft flights shall also be effectively damped by the present invention.

It is known to use so-called secondary damping means for damping vibrations of equipment such as machines in a factory. However, the possibilities of using secondary damping means are unknown in the construction of buildings except for the use of so-called plastic hinges in the steel reinforcement of buildings whereby the surrounding concrete is deformed in a plastic manner. The damping caused by such plastic deformation is taken into account when calculating the dimensions of earthquake proof buildings. However, the damping becomes effective only at relatively large loads. Additionally, the resulting deformations are not reversible. Vibrations below this large load limit are damped only by the relatively small inherent or self-damping of the construction materials. Therefore, there is room for improvement in the art of damping large structures against vibrations in a wide range of frequencies.

OBJECTS OF THE INVENTION

In view of the above, it is the aim of the invention to achieve the following objects singly or in combination:

to provide a method and apparatus for increasing the damping of vibrations to which buildings may be subject by using so-called secondary damping means in addition to the inherent or self-damping caused by the building materials;

to increase the safety of buildings and large structures against earthquakes;

to employ damping means which are effective in large structures such as buildings, bridges, and the like over a wide frequency range so as to reduce vibrations caused, for example, by people walking on a concrete floor, by operating machinery, by traffic vibrations, and so forth; and to arrange so-called secondary damping means in such a manner that force components of the forces that cause the vibrations must travel through the damping material, preferably repeatedly.

SUMMARY OF THE INVENTION

The invention achieves the above objectives by securing metal members which are at least partially coated with a damping material in or on the concrete components of a building or the like. In one embodiment, the metal members forming the damping inserts are provided by dividing concrete reinforcing steel rods or bars into sections whereby each section has a length L, a cross-section F, and a circumferential length U. The reinforcing steel rods or bars have an elasticity modulus E. The damping material which coats or envelopes the steel rod sections has a modulus of shearing G and a thickness d. Taking these elements into account, it has been found that an optimal damping effect is accomplished if the following equations are satisfied.

$$(2E/G'')\cdot(dF/L^2U)=1 \quad (1)$$

$$G=iG'' \quad (2)$$

$$d<<F/U \quad (3)$$

This optimization is achieved when the damping material has a pure plastic response characteristic so that its shearing modulus G corresponds to $$G=iG'', \quad (2)$$

wherein i corresponds to imaginary unit and wherein G'' corresponds to loss shearing modulus. This condition is satisfied by materials which also satisfy the Newton friction or viscosity characteristic. Such materials comprise, for example, high polymers, tar, or even solid lubricating materials such as graphite.

In another embodiment, the vibration damping material coats one surface of a sheet metal member which has a grid pattern of grooves on one surface and of corresponding ridges on the other surface. Such a sheet metal member is secured in a force transmitting manner to the concrete component so that the vibration damping material is enclosed between the sheet metal member and the surface of the concrete component or between two metal sheets.

According to a further embodiment of the invention, it is not necessary to completely sever a steel rod or bar for providing the several sections arranged in a row. It has been found to be satisfactory if the cross-sectional area of the steel rods or bars is modified at spaced intervals by indentations, bulges, or the like. These cross-section modifications cause a reduction in the spring stiffness of the reinforcing rod or bar so that when the structure is exposed to a vibratory load, the respective force flow does not travel merely within the reinforcing steel insert, but rather through the damping layer from one steel rod section to the other.

According to a further embodiment of the invention, conventional structural steel components are enveloped by a jacket of synthetic material having damping characteristics. Thus, when the enveloped structural steel is exposed to vibratory movements, the jacket of synthetic material is deformed in a plastic manner, thereby damping the forces which tend to expose the structure to vibrations.

BRIEF FIGURE DESCRIPTION

In order that the invention may be clearly understood, it will now be described, by way of example, with reference to the accompanying drawings, wherein:

FIG. 7 is a further modification in which a steel rod or bar is not interrupted in its diameter but enveloped by vibration damping material and encased by a sheet metal jacket;

FIG. 8 shows an embodiment in which the steel rod diameter is modified by spaced bulges;

FIG. 9*a* is a top plan view of a sheet metal member partially broken away and provided with ridges or grooves according to the invention;

FIG. 9*b* is a sectional view through a sheet metal member of FIG. 9*a* attached to a concrete structural component; and FIG. 10 shows a reinforcing bar constructed as shown in any one of FIGS. 1 to 8 and shaped into a zig-zag or wave form.

DETAILED DESCRIPTION OF PREFERRED EXAMPLE EMBODIMENTS AND OF THE BEST MODE OF THE INVENTION

Figure 1:
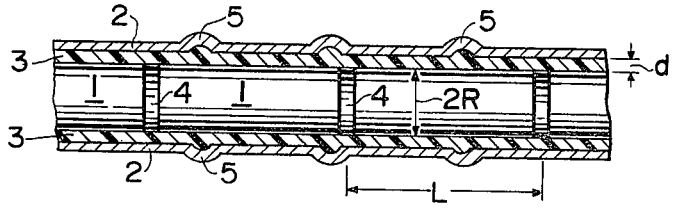
FIG. 1 is a longitudinal section through a segmented structural steel member such as a rod or bar modified according to the invention.

FIG. 1 shows one basic embodiment of the invention comprising metal members 1 in the form of sections cut from structural steel such as a steel rod or bar. Each metal member or section 1 has a length L and a diameter corresponding to 2R. The modulus of elasticity E applies to each of the sections 1. All the sections 1 are arranged in a row which is enveloped by a vibration damping material 3, for example in the form of a high polymer, tar, solid lubricating means and the like. The envelope 3 is encased by a sheet metal jacket or sleeve 2. The damping material 3 has a shearing modulus G and a thickness d. The spaces 4 between adjacent sections 1 may also be filled with the damping material. The jacket 2 is provided with surface increasing projections 5 for improving the bonding between the surface of the jacket 2 and the concrete in which the reinforcing rods, prepared according to the invention, are embedded. These projections 5 assure a force transmitting connection between the jacket 2 and the embedding concrete.

If the structure, such as a building, is exposed to a vibrating load after it has been equipped with the damping means according to the invention, the vibrating force components are transmitted through the sheet metal jacket 2 and through the damping material 3 into the steel sections 1. The interruptions 4 between adjacent steel sections 1 make sure that the flow of the force cannot take place directly from one section into the next adjacent section but must travel through the damping material. This force flow of the force components repeatedly through the damping material results in an optimal utilization of the damping effectiveness of the damping material 3. It has been found, that such optimal utilization is achieved if the following conditions are met.

$$d << R \quad (4)$$

$$1=(E/G'')(dR/L^2)\ (\cong(2E/G'')(dF/L^2U)) \quad (5)$$

$$G=iG'' \quad (6)$$

In these equations the elements have been set forth above and i corresponds to the imaginary unit ($=\sqrt{-1}$) and G'' corresponds to loss shearing modulus. If these conditions are satisfied, the reinforcing rod may be treated as a homogeneous rod as if it does not have the interruptions or gaps 4 whereby the modulus of loss E''

$$E''=\tfrac{3}{8}E.$$

It is known that the modulus of loss E'' is responsible for the irreversible dissipation of vibration energy. Compared to any conventional, organic anti-noise coatings as they are employed in machine construction, the damping insert means according to the invention achieves a substantially higher damping effect which is in the order of 2–4 powers of ten larger than the damping effect achieved by said conventional anti-noise coatings.

A further improvement in the damping effect or efficiency to the maximum possible value may be achieved if $E''=0.5E$ is assured. This may be achieved if the damping material 3 is located only around the ends of the adjacent steel sections 1.

Figure 2:
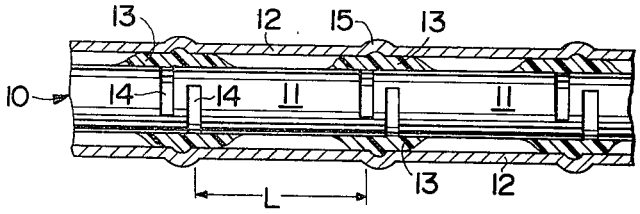
FIG. 2 is a view similar to that of FIG. 1 whereby the cross-sectional area of the steel rod or bar is modified without completely severing adjacent sections from each other.

FIG. 2 shows a structure similar to that of FIG. 1. However, in FIG. 2 the steel rod 10 is modified in its cross section only by cuts or partial gaps 14 which do not extend entirely through the steel rod 10 but form sections 11 which again have a length corresponding substantially to L. These gaps 14 may overlap to some extent as shown in FIG. 2. Further, the gaps 14 reduce the spring constant of the steel rod 10 relative to tension loads applied to the ends of the steel rod. The gaps or cuts 14 also cause an interruption of the longitudinal force flow so that the vibration causing force components must travel through damping material 13 which may be located only around the zones adjacent to the gaps 14 and not along the entire length of the rod 10. The damping material 13 may enter into the cuts or gaps 14. A sheet metal jacket 12, provided with burrs or projections 15 facing radially outward, surrounds the steel rod 10 and the damping material 13 as in FIG. 1. By arranging the damping materials 13 at the ends of the sections 11, the maximum loss modulus $E''=0.5\,E$ is achieved.

Figure 3:
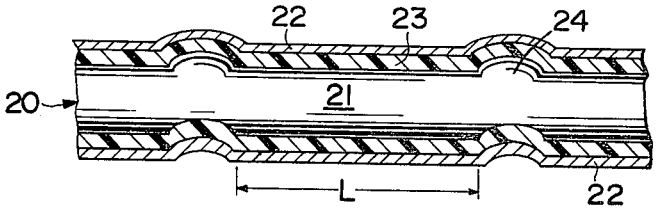
FIG. 3 shows a steel rod or bar in a longitudinal section whereby the rod is provided with buckling bulges and additionally is enveloped by a vibration damping material which is in turn encased by a sheet metal jacket.

In FIG. 3 the steel rod 20 is modified in its cross-sectional area by arcs 24 which are again spaced to provide steel rod sections 21 having a length L. The entire rod, including the arc 24 is enveloped by a vibration damping material 23 which in turn is jacketed by a sheet metal casing 22 which also encloses the arcs 24.

Figure 4:
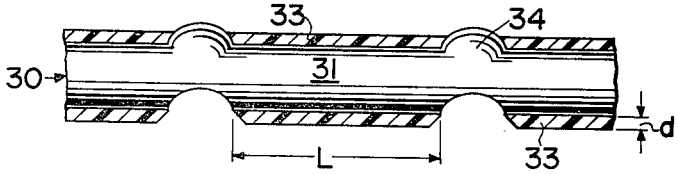
FIG. 4 is a view similar to that of FIG. 3, however without the sheet metal jacket.

In FIG. 4 which is comparable with the structure of FIG. 3 the outer jacket has been omitted. In FIG. 4, the steel rod 30 is divided into sections 31 having the length L between adjacent bulges 34. These bulges also reduce the spring constant of the steel rod 30 relative to tension loads. The steel sections 31 are enveloped by a vibration damping coating 33 which does not cover the bulges 34. When the structure of FIG. 4 is embedded in concrete, the damping layer 33 is deformed in a plastic manner in response to vibration loads to which the concrete structural component is exposed. The thickness d of the vibration coating or envelope 33 and the length L of the sections 31, as well as the elasticity module of these sections, are again selected to satisfy the conditions of the equations set forth above.

Figure 5:
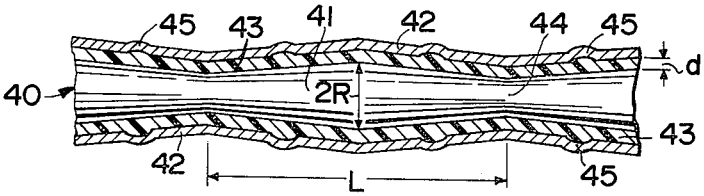
FIG. 5 is a longitudinal sectional view through a further embodiment in which the cross-sectional area of the steel rod has been modified by diameter restrictions.

FIG. 5 shows an embodiment in which the steel rod 40 is modified in its cross-sectional area by diameter reducing neck portions 44 spaced at intervals to provide sections 41 having a length L. The so prepared structural reinforcing rod or bar is enveloped by a damping material 43 which again is jacketed by a sheet metal casing 42 having radially outwardly facing burrs or projections 45 for assuring a positive force transmission between the sheet metal jacket 42 and the concrete in which the structure is embedded. Here again, the vibration causing force components must repeatedly travel through the vibration damping material 43 as it passes from the embedding concrete into the steel rod sections 41.

In the embodiment of FIG. 5, the maximum possible modulus of loss $E''=0.5E$ will also be achieved if the conditions set forth above are satisfied.

Figure 6:
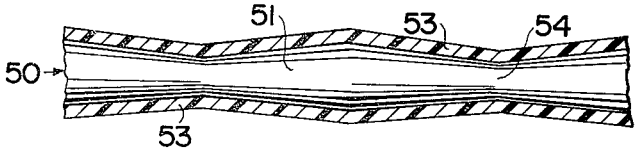
FIG. 6 is a view similar to that of FIG. 5, however without a sheet metal casing.

FIG. 6 shows an embodiment similar to that of FIG. 5. However, in FIG. 6 the sheet metal jacket has been omitted. Thus, the rod 50 is divided into sections 51 which are surrounded by a damping material 53 which is directly embedded in the concrete structural component. The neck sections 54 reduce the diameter of the steel rod in the same manner as in FIG. 5.

FIG. 7 shows an embodiment which achieves the purposes of the invention by a steel rod 61 which is not modified in its diameter along its length. The steel rod 61 is enveloped by a damping material 63 which in turn is encased by a sheet metal jacket 62 having the surface increasing projections 65 for a proper force transmission between the concrete and the sheet metal jacket 62. The overall length of the steel rod 61 in FIG. 7 should substantially correspond to one-half of the wave length of a vibration that is to be damped. If this further condition is met, the same dimensioning requirements apply, as set forth above with reference to FIGS. 1–4, for an optimal utilization of the damping characteristic of the damping material 63. Further, if the vibrations to be damped have varying wave lengths, a maximum damping may still be achieved if the damping material 63 has a modulus of shearing which increases with the frequency f of the vibrations. Viscose materials which satisfy Newton's liquid friction characteristics will also satisfy the requirement of a shearing modulus which increases with the frequency of the applied vibration. A vibration damping material having a viscosity $\mu$ will have a shearing modulus $G=i\,G''=i\,f\mu$, wherein i is the imaginary unit and f is said frequency and $\mu$ is said viscosity of the damping material.

FIG. 8 shows a structure similar to that of FIG. 7 however with the omission of the outer jacket. Additionally, in FIG. 8 the steel rod or bar 71 is provided with bulges 75 which improve the force transmission between the concrete in which the steel rod 71 with its vibration material envelope 73 is embedded. The envelope 73 is made of a material which is not attacked by the concrete. Synthetic plastic materials or bituminous materials, such as tar, have been found to be suitable for this purpose. This applies also to the embodiment of FIGS. 4 and 6, as far as the coating 33 and the coating 53 are concerned.

The foregoing embodiments shown in FIGS. 1–8, comprise structural steel in the form of rods or bars. Such rods or bars modified as taught here may be embedded in the concrete in a conventional manner by forming grids of these rods or bars. FIG. 10 shows a modification in which a bar 91 modified according to the invention is inserted into a concrete wall so that the nodes 92 of the zig-zag or wave form shaped bar are located near the wall surfaces while the bar itself meanders from wall surface to wall surface throughout the concrete wall. This type of arrangement results in exposing the reinforcing rod structure to higher loads and accordingly the damping effects are also higer than in an embodiment where the embedding takes place conventionally.

The sheet metal jackets which are used, for example, in FIGS. 1, 2, 3, 5, and 7 may be manufactured by first cutting sheet metal strips, the longitudinal edges of which are then interconnected by a double flanged seam. Such double flanged seam simultaneously improves the form locking or force transmitting connection or bonding between the sheet metal jacket and the concrete in which the sheet metal jacket with the metal members and dumping material is embedded, However, the sheet metal jacket may also be formed by winding a sheet metal strip in a spiral shape around the metal members. In these production methods, it is suitable to first apply the damping material to the sheet metal strip which is then wound onto the metal members.

FIG. 9*a* shows a top plan view of a portion of a surface type damping structure comprising a sheet metal member 80 divided into square elements 81 by ridges 84 appearing on the surface facing the viewer. These ridges 84 form grooves 84' on the surface facing away from the viewer. As shown in FIG. 9*b*, the surface of the sheet metal piece facing the concrete is coated by damping material 83 which may directly face the concrete or which may be covered by a further sheet metal member 82. In both instances, the sheet metal member 80 will be connected in a force transmitting manner to the concrete, for example, by means of anchors 86 embedded in the concrete. The ridges or grooves 84, 84' decouple the individual squares 81 from one another with regard to the transmission of tension loads.

The just described embodiment may also be dimensioned analogous to the master equations (1)–(3). In the special case of FIG. 9 one get $$(2\,E/G'')(dh/L^2)=1 \tag{7}$$

$$G=iG'' \tag{8}$$

$$d<<h \tag{9}$$

There the metal square elements 81 have the side length L, the thickness h and the elasticity modulus E. The damping material 83 has a thickness d and the shear modulus G.

In the damping inserts, according to FIGS. 1–8, it has been found that the so-called inherent damping may be increased by 100% if the reinforcement degree corresponds to about 0.1–0.3% by volume. The best damping effect is accomplished when the damping insert is located as far away from the neutral axis or neutral fiber as possible. In other words, the reinforcing rods modified as taught herein should be embedded in the concrete in locations where tension loads are concentrating along the edges and in the corners of the concrete components.

With regard to FIGS. 9*a* and 9*b*, it will be appreciated that the damping structure may be applied to concrete components after the latter have been poured. It is, however, required that the anchoring members 86 are firmly connected in a force transmitting manner to the concrete components.

Although the invention has been described with reference to specific example embodiments, it will be appreciated, that it is intended, to cover all modifications and equivalents within the scope of the appended claims.

What is claimed is:

1. A method for damping vibrations in a large structure including poured concrete components, comprising the following steps: covering at least a portion of a metal member with a vibration damping material, and securing the metal member in a force transmitting manner in or to said concrete components in such a manner that vibration causing force components must travel at least partially through said vibration damping material, using as said metal member concrete reinforcing rod means, enveloping said reinforcing rod means with a layer of vibration damping material, encasing the enveloped reinforcing rod means and the vibration damping material in a sheet metal jacket, and embedding the enveloped and encased rod means in the concrete components when the concrete is being poured.

2. The method of claim 1, further comprising modifying the cross-section of said rod means at spaced intervals to form rod sections along the length of the rod means so that vibration causing force components must travel at least partially through said vibration damping material when passing from rod section to rod section.

3. The method of claim 1, wherein said vibration damping material is a thin layer having a modulus of shearing which increases with an increasing frequency of said vibrations in accordance with Newton's friction characteristic curve.

4. The method of claim 1, wherein said metal rod means are embedded in said concrete components at locations where loads, especially tension loads, are concentrated.

5. The method of claim 1, further comprising shaping said rod means into a zig-zag or wave form prior to said embedding.

6. A method for damping vibrations in a large structure including poured concrete components, comprising the following steps: covering at least a portion of a metal member with a vibration damping material, and securing the metal member in a force transmitting manner in or to said concrete components in such a manner that vibration causing force components must travel at least partially through said vibration damping material, using as said metal member a piece of sheet metal, forming prior to said covering step in said sheet metal a checker board type grid pattern of grooves on one surface of the sheet metal, said grooves forming ridges on the opposite side of said sheet metal, performing said covering by coating at least one surface of said sheet metal with said vibration damping material, and securing the sheet metal in a force transmitting manner to a concrete component so that the vibration damping material faces toward the concrete.

7. The method of claim 6, wherein said vibration damping material is applied to cover the surface of the sheet metal with the grooves therein so that the grooves are filled by said vibration damping material.

8. The method of claim 6, wherein said securing comprises anchoring attaching hooks to one surface area of the sheet metal and embedding said hooks in said concrete components.

9. The method of claim 1, or 6 further comprising optimising the damping effect by coordinating the physical characteristics of said metal member and of said damping material so that the following conditions (a) and (b) are substantially satisfied:

$$G = i\,G'' \qquad \text{(a)}$$

$$1 = 2(E/G'')(d\,F/L^2U), \qquad \text{(b)}$$

wherein

G is the modulus of shear of the damping material, i is the imaginary unit ($=\sqrt{-1}$)

G'' is the loss shearing modulus of the damping material d is the thickness of the damping material, E is the modulus of elasticity of the metal member, L is the length of each metal member, F is the cross-sectional surface area of metal member, U is the circumferential length of the metal member.

10. The method of claim 6, further comprising sandwiching said coating of vibration damping material in a force transmitting manner between said piece of sheet metal and a further piece of sheet metal (82), and anchoring said further piece of sheet metal to a concrete component also in a force transmitting manner.

11. An apparatus for damping vibrations in a large structure including poured concrete components, comprising a metal member, vibration damping material covering at least a portion of said metal member, and means securing the metal member in or to a respective concrete component in such a manner that vibration causing force components must travel at least partially through said vibration damping material, wherein said metal member is a concrete reinforcing rod means, wherein said vibration damping material is a coating on said rod means, wherein said securing means are provided by the embedding of the enveloped rod means in the respective concrete component, and sheet metal jacket means encasing the enveloped rod means, said concrete component being bonded to the sheet metal jacket means.

12. The apparatus of claim 11, further comprising cross-sectional area modifying means as part of said rod means, said modifying means being located at spaced intervals along the length of said rod means to form rod sections, whereby vibration causing force components must pass at least partially through the vibration damping material when passing from rod section to rod section.

13. The apparatus of claim 12, wherein said rod means have a zig-zag or wave-form shape.

14. The apparatus of claim 12, wherein said cross-sectional area modifying means comprise cuts partially or completely separating the rod means into said rod sections.

15. The apparatus of claim 12, wherein said cross-sectional area modifying means comprise diameter reducing restrictions spaced along said rod means.

16. The apparatus of claim 12, wherein said cross-sectional area modifying means comprise bulges spaced along said rod means.

17. The apparatus of claim 11, wherein said sheet metal jacket means comprise an outer jacket surface facing away from said vibration damping material, said outer jacket surface comprising surface area increasing means thereon for intimately bonding the jacket means to a concrete component.

18. An apparatus for damping vibrations in a large structure including poured concrete components, comprising a metal member, vibration damping material covering at least a portion of said metal member, and means securing the metal member in or to a respective concrete component in such a manner that vibration causing force components must travel at least partially through said vibration damping material, wherein said metal member is a piece of sheet metal having grooves on one side of the sheet metal and respective ridges on the other side of the sheet metal, said grooves and ridges forming a checkerboard grid pattern, said damping material forming a coating on at least one surface of said sheet metal, said securing means comprising hook means attached to one surface of the sheet metal so that the vibration damping material is enclosed between the concrete and the sheet metal when the hook means are embedded in the concrete.

19. The apparatus of claim 18, wherein said vibration damping material fills the grooves in said sheet metal.

20. The apparatus of claim 18, comprising a further piece of sheet metal (82) arranged in parallel to said first mentioned piece of sheet metal with said damping material (83) sandwiched between the two pieces of sheet metal in a force transmitting manner, and wherein said securing means (86) are attached to one of the two pieces of sheet metal.

* * * * *